United States Patent [19]

Tinnes

[11] 3,997,090

[45] Dec. 14, 1976

[54] DEVICE AND METHOD FOR FORMING A MORTAR JOINT PACKING BETWEEN A VESSEL OUTLET AND A REMOVABLE CLOSURE

[75] Inventor: Bernhard Tinnes, Zollikerberg, Switzerland

[73] Assignee: Metacon A.G., Zurich, Switzerland

[22] Filed: July 8, 1975

[21] Appl. No.: 593,981

[30] Foreign Application Priority Data

July 12, 1974 Switzerland ..... 9622/74

[52] U.S. Cl. ..... 222/590; 222/600

[51] Int. Cl.[2] ..... B22D 41/08

[58] Field of Search ..... 222/566, 567, 591, 600, 222/590; 266/38; 264/30

[56] References Cited

UNITED STATES PATENTS

| | | | |
|---|---|---|---|
| 3,779,742 | 12/1973 | Fehling et al. | 222/600 |
| 3,801,083 | 4/1974 | Manley et al. | 266/38 |

FOREIGN PATENTS OR APPLICATIONS

| | | | |
|---|---|---|---|
| 1,145,205 | 3/1963 | Germany | 222/591 |

*Primary Examiner*—Stanley H. Tollberg
*Assistant Examiner*—David A. Scherbel
*Attorney, Agent, or Firm*—Cushman, Darby & Cushman

[57] ABSTRACT

A device for forming a mortar joint between a closure member and the outlet spout for a vessel which is used for handling molten material; the closure element has a bore which is alignable with the spout of the vessel and a cylindrical sheath constructed from combustible material is disposed concentrically with the bore of the closure element with the mortar material disposed on the face of the closure element that is to be placed in contact with the surface area surrounding the spout of the vessel; cooperating guide means are provided on the vessel or on the closure member for properly aligning the cylindrical sheath with the spout of the vessel so that, when the closure member is placed in abutting relationship with the spout of the vessel, the mortar material will form a sealing joint packing between the face of the spout and the face of the closure member while the cylindrical sheath will prevent ingress of mortar material into the bore of the closure member.

3 Claims, 3 Drawing Figures

DEVICE AND METHOD FOR FORMING A MORTAR JOINT PACKING BETWEEN A VESSEL OUTLET AND A REMOVABLE CLOSURE

BACKGROUND AND BRIEF DESCRIPTION OF THE INVENTION

The present invention relates to devices for forming a mortar joint packing between the closure member and spout of a vessel for containing molten metal and then, more particularly, to a joint packing that will permit relining of a portion of the dispensing spout of the vessel.

Modern closure members of casting vessels in the form of sliding gate valves are mounted to and removed from, respectively, the casting vessel as units when replacement of parts of these valves due to wear is necessary. Such sliding closures are provided with a base plate which is designed to be placed in contact with a refractory sheath which constitutes part of the dispensing outlet of the vessel. In practice, the opposing surfaces of these parts require packing material since an intermediate space of several millimeters width normally exist between them when they are placed in abutting relationship. It has been the practice in filling these surfaces to spread refractory mortar on the surface of the base plate and also on the sheath of the vessel to form a joint when the sliding closure is applied to the vessel. Excess mortar, of course, will be forced into the discharge opening of at least the sliding closure and as a consequence this excess mortar must be removed before the casting operation is commenced. Since the vessel's outlet and the sliding closure are difficult to reach, it is very time-consuming and laborious undertaking to first clean the discharge opening of the sliding closure and then clean out any mortar that is forced into the discharge opening when the sliding closure is mounted and sealed on the vessel's opening.

In order to solve this difficulty, an attempt has been made to utilize an annular plate of fire resistant ceramic or mineral fibers as a joint packing between the sliding closure and the opening of the vessel. However, if such types of packing material are too strongly compressed, they cannot practically be deformed to provide a satisfactory seal, particularly when the refractory material about the vessel's opening has been partially worn away due to use and contact with the molten metal. Moreover, using and positioning plates of ceramic or mineral fibers of different thicknesses to accomodate variations and irregularities in the surface about the vessel's openings is an expensive alternative which does not assure a leakproof sealing. Softer packing elements made from such materials, on the other hand, undergo pronounced deterioration as a result of exposure to the molten metal and thus can withstand only a few number of charges passing through the vessel.

The present invention avoids the foregoing difficulties of the prior art and provides several useful advantages that were not heretofore available in this field. In particular, the present invention provides a device for establishing a packing of the joints between a sliding closure and a vessel for molten metal by the use of refractory mortar material in a manner which eliminates the necessity of removing any excess mortar displaced from the joint when the surfaces are forced together.

In a preferred embodiment, the device of the present invention utilizes a cylindrical sheath, at least a portion of which has an external diameter which fits into the bore of the base plate of the sliding closure. The cylindrical sheath is constructed from material that will be consumed by the molten metal that flows out of the vessel either by melting or by combustion when the metal comes into contact with the sheath. More specifically, the sheath may be made of cardboard which is impregnated or coated with suitable agents to increase the carbon content thereof. Also, the sheath may be coated or impregnated with a material that will delay combustion or which will create an exothermal reaction when the sheath is contacted by the molten metal.

The joint material itself is preferably a chemical-ceramic refractory binding mortar due to its significant resistance to deterioration when contacted by liquid metal.

By the use of the cylindrical sheath of the present invention, the opening in the sliding closure is maintained in a cleaned condition while the joint is being formed about the bore in the base plate of the sliding closure and about the mouth of the outlet in the vessel.

Quite unexpectedly, with the use of the device of the present invention where the mouth of the outlet of the vessel has deteriorated so as to become uneven and an annular gap results between the surface of the sheath and the bore of the outlet of the vessel, the annular gap can be smoothed over and filled in by the refractory mortar when the joint between the sliding closure and the vessel opening is formed. As a result, the discharge opening of the vessel will be maintained in its original dimensions at least adjacent the critical area of discharge at the mouth of the bore's outlet thus preserving the favorable flow conditions required for accurate casting operations. Also, as a result, the refractory covering material of the vessel's outlet as well as the bore in the base plate of the sliding closure will last substantially longer.

It is the general practice in reducing metal to a liquid state to fill the discharge opening of the vessel with a quantity of fire-dried, fine-grain quartz sand in order to prevent the liquid metal from getting into the discharge opening where it would rapidly solidify due to the relatively cooler temperatures of the surfaces. It can be readily appreciated then that the task of freeing the discharge opening of the vessel for the purpose of tapping the vessel would become a very difficult or impossible task. Even with the use of quartz sand as an insulating material, however, it happens that the outlet opening has to be burnt free of the sand prior to tapping of the vessel due to the fact that the sand grains bake together by virtue of a chemical reaction with the surrounding refractory surfaces which are at high temperatures.

By utilizing a cylindrical sheath on the sliding closure in accordance with the present invention which is made of cardboard or other material that will burn to carbon, this problem is markedly reduced since the carbon residues which result in the combustion of the sheath inhibit the chemical reaction between the quartz sand and the refractory surfaces while the rheologic property of the quartz sand is maintained until the opening of the slide closure. The supply of carbon residues can be supplemented if the sheath is impregnated or coated with graphite. One consequence of the foregoing is that the necessity for burning out the discharge opening of the vessel is eliminated. In some instances it may be advantageous to impregnate the sheath with waterglass in order to delay the burning of the sheath.

The foregoing and other advantages will become apparent as consideration is given to the following detailed description taken in conjunction with the accompanying drawings in which:

DETAILED DESCRIPTION OF THE INVENTION

Figure 1:
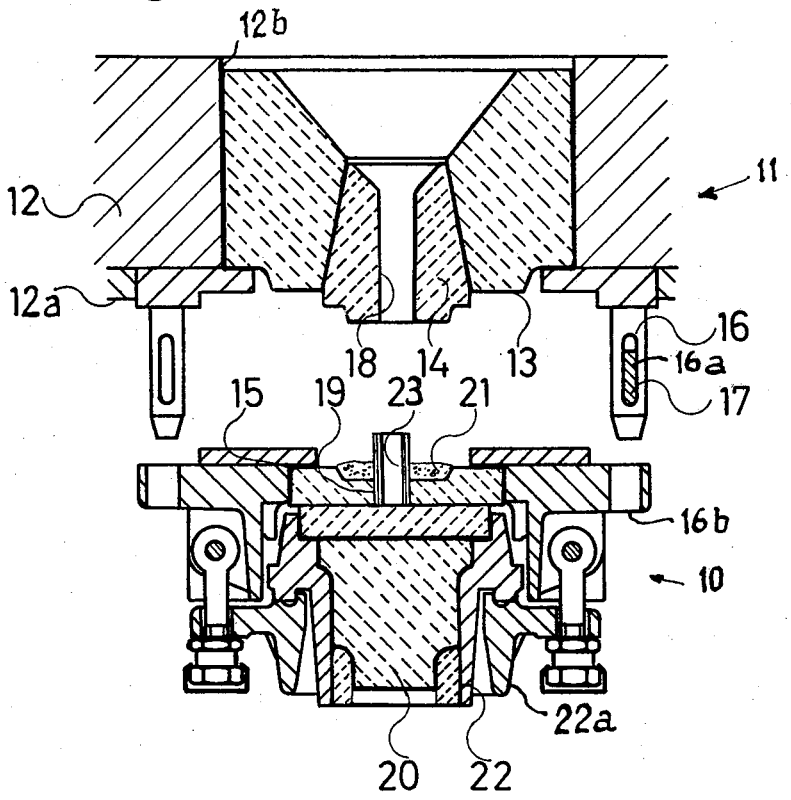
FIG. 1 is an illustration of a sliding closure disposed beneath the outlet of a casting vessel in cross-section.

Referring to the drawings, wherein like numerals designate corresponding parts throughout the several views, there is shown in FIG. 1 a sliding closure assembly designated generally by the numberal 10, and the base of a vessel for metallic melts designated generally by the numeral 11. Vessel 11 has a wall 12 and a base 12*a* with the base 12*a* and wall 12 having a concentric opening 12*b* formed therein. In the opening 12*b* there is located a refractory member 13 and a member 14 made of like material both of which are annular in shape to define an outlet of the vessel 11. The member 14, of course, is fixed in the opening of member 13 by any suitable means such as a refractory mortar material. Also the member 13 may be fixed to the walls of the opening 12*b* and held in place by an annular flange provided by the base 12*a*.

Extending generally perpendicularly from the base 12*a* are bolts 16 each of which are provided with longitudinal slots 16*a* for the purpose of receiving a wedge member 17 after the bolts 16 are inserted through the apertures 16*b* formed in the upper face of the sliding closure 10. With this arrangement, a secure fastening of the sliding closure 10 to the base 12*a* of the vessel 11 can be effected.

With reference now to FIG. 1, the adjacent surfaces of sheath 14 and base plate 15 when the sliding closure is fixed by means of the bolts 16 and wedges 17 to the base 12*a* of the vessel 11, form the joint designated at 30. The sliding closure 10 is shown in its closed position with its bore 20 out of alignment with the bore 19 in the base plate 15 which is its usual position before it is fastened to the vessel 11. Bore 18 of the sheath member 14, bore 19 of the base plate and bore 20 of the movable slide element 22 together form the discharge opening through which the molten metal will pass when the closure member 10 is moved to its open position by properly orienting bore 20 as a result of movement of the slidable member 22 on its support member 22*a*.

In bore 19, according to the present invention, a cylindrical sheath 23 is fitted which is substantially longer than the thickness of base plate 15. An appropriate amount of mortar material 21 serves as the packing for the joint 30. By virtue of the use of the sheath 23, the mortar is easily deposited on the face of base plate 15 since it is unnecessary to exert particular care to prevent the mortar from occupying the bore 19 due t the presence of the sheath 23.

In order that the joint 30 may be uniformly filled with the mortar 21 after the fastening of the sliding closure 10 on the vessel 11, it is advantageous to place the mortar by means of a template in a form whih approximately corresponds to the form and distribution desired in the joint. Such a template may be oriented by rotation about sheath 23 on the upper face of the sliding closure 10.

Figure 2:
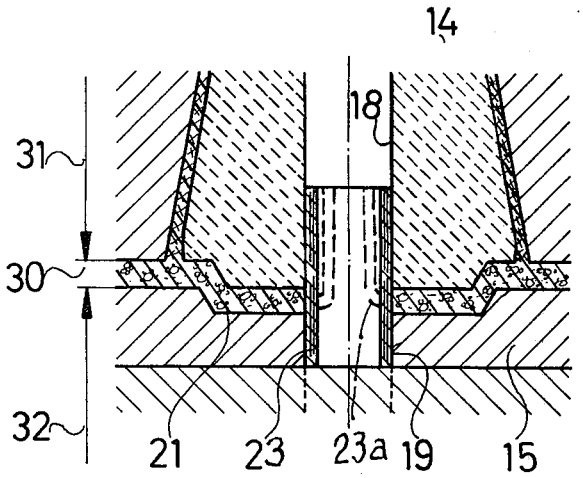
FIG. 2 is a detailed view of a joint in assembled condition of the sliding closure and vessel of FIG. 1.
Figure 3:
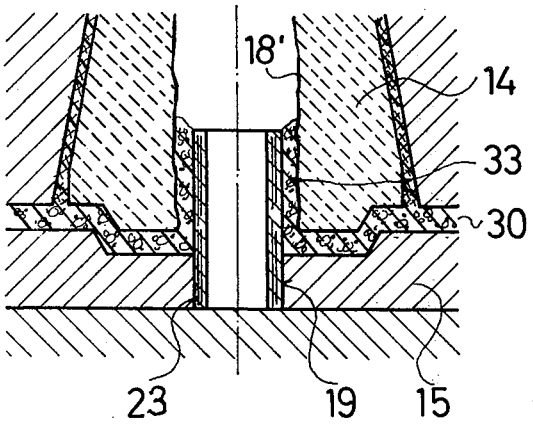
FIG. 3 is a view similar to that of FIG. 2 except that the bore of the outlet of the vessel has been widened due to deterioration.

Details of the joint in the assembled condition of the sliding closure 10 and vessel 11 are shown in FIGS. 2 and 3 wherein the joint is designated 30 and the portion of the vessel 11 by the arrow 31 and the portion of the sliding closure 10 by the arrow 32.

In FIG. 2, the sheath 14 which is intended for several operations, has a bore 18 which in its initial unused condition is of the same diameter as bore 19 in the base plate 15. Sheath 23 has a lower portion disposed in bore 19 and covers adjacent areas of joint 30 in the bores 19 and 18 as illustrated in order to prevent penetration of mortar into these bores. By pressing the sliding closure 10 in the direction of the arrow 32, the mortar 21 will be correspondingly evenly distributed in joint 30. The temperature of the refractory wall 12 of vessel 11 is, in most instances, at a relatively high value in the order of several hundred degrees centigrade either due to preheating or residual heat from the previous charge of molten metal. Sheath 23 will, therefore, melt when exposed to such heat or will burn upon of the sliding closure 10 with the residues of the sheath spilling out through the bore 20.

With reference now to FIG. 3, there is shown a configuration of the joint 30 after the fixing of the sliding closure 10 to the vessel 11 but with a bore 18' which has already deteriorated to a degree due to passage of molten metal therethrough and thus has a wider diameter than the original bore 18. As a result, bore 18' will be wider in diameter than bore 19 in base plate 15. When sheath 23 is inserted into bore 18', an annular gap 33 will exist between the external surface of the sheath 23 and the surface of bore 18'. This will permit some of the mortar material 21 to penetrate into and fill gap 33 as indicated in FIG. 3. When the sliding closure 10 is opened again, of course, the sheath 23 will be consumed with the residue passing out through the sliding closure opening but the outlet opening in the zone of joint 30 particularly in bore 18' will provide a clean passage surface thus allowing optimum flow conditions for the liquid metal. Additionally, base plate 15 in the area of its bore 19 will be protected from what would normally be increased exposure to the molten metal and thus its life expectancy will be prolonged. Also, the life of the sheath 14 is obviously prolonged by virtue of the presence of the mortar in annular gap 33 which provides a protection surface for the sheath 14.

In some cases, it may be desirable when using a new sheath 14 with undeteriorated bore surface 18 to provide additional mortar material over the lower portion of the bore 18 to thus prolong the useful life of the sheath 14. This can be achieved by forming the upper portion 23*a* shown in dotted lines in FIG. 2 with a smaller external diameter to provide a gap similar to the annular gap 33 illustrated in FIG. 3. Use of a smaller diameter upper portion 23*a* also facilitates insertion of the sheath 23–23*a* into the bore 18 when the sliding closure 10 is mounted on the vessel.

Having described the preferred embodiments of the invention, it will be understood by those skilled in this art that various modifications may be made therein without departing from the spirit and scope of the invention as defined in the appended claims.

What is claimed is:

1. In a device for closing the outlet bore of a vessel of the type used for containing molten metallic material where the device includes a movable closure member having a bore alignable with the outlet bore of the vessel and a plate member having a bore, said plate member having a surface that is bonded to said vessel with said bore of said plate member in alignment with said outlet bore, the improvement comprising a sheath member constructed from cardboard and impregnated with water glass material, said sheath member having one end inserted into said bore of said plate member and its other end inserted into said outlet bore of said vessel, said sheath member's material being consumable upon exposure to the molten material in said vessel.

2. A method of forming a mortar joint between a closure member and an outlet bore of a vessel used for containing molten material, said closure member having a bore alignable with the bore of said vessel, the steps comprising:

A. disposing one end of a cylindrical hollow sheath of consumable material into said bore of said closure member;

B. applying mortar material to the surface of said closure member surrounding said sheath; and C. closing said closure member by inserting the other end of said sheath into said bore of said vessel while forcing said mortar material into intimate contact with the surface of said vessel surrounding said vessel's bore.

3. The method as claimed in claim 2 wherein said other end of said sheath has an exterior diameter that is smaller than the interior diameter of said bore of said vessel, including the step of forcing mortar material into said bore of said vessel between said sheath and the interior surface of said bore of said vessel to line the interior surface of said vessel's bore with said mortar material.

* * * * *